US008918027B2

(12) United States Patent
Fowler et al.

(10) Patent No.: US 8,918,027 B2
(45) Date of Patent: Dec. 23, 2014

(54) APPARATUS AND SYSTEMS INCLUDING AN IMAGING MODULE AND DEVELOPER MODULE INSTALLABLE IN AN ELECTROSTATOGRAPHIC PRINTING SYSTEM

(71) Applicant: Xerox Corporation, Norwalk, CT (US)

(72) Inventors: Jeffrey M. Fowler, Rochester, NY (US); Ian Harpur, Welwyn Garden, GA (US)

(73) Assignee: Xerox Corporation, Norwalk, CT (US)

( * ) Notice: Subject to any disclaimer, the term of this patent is extended or adjusted under 35 U.S.C. 154(b) by 37 days.

(21) Appl. No.: 13/727,571

(22) Filed: Dec. 26, 2012

(65) Prior Publication Data

US 2014/0178104 A1 Jun. 26, 2014

(51) Int. Cl.

| | |
|---|---|
| ***G03G 15/08*** | (2006.01) |
| ***G03G 21/18*** | (2006.01) |
| ***G03G 21/12*** | (2006.01) |
| ***G03G 21/10*** | (2006.01) |

(52) U.S. Cl.

CPC ..... *G03G 21/1814* (2013.01); *G03G 21/12* (2013.01); *G03G 15/0844* (2013.01); *G03G 15/0877* (2013.01); *G03G 21/105* (2013.01); *G03G 21/1817* (2013.01)

USPC ..... 399/258; 399/120; 399/262; 399/359

(58) Field of Classification Search

CPC ..... G03G 15/0822; G03G 15/0832; G03G 15/0837; G03G 15/0839; G03G 15/09; G03G 21/10

USPC ..... 399/258–260, 262, 263, 359, 111, 119, 399/120

See application file for complete search history.

(56) References Cited

U.S. PATENT DOCUMENTS

| | | | | |
|---|---|---|---|---|
| 6,625,404 | B2 * | 9/2003 | Watanabe et al. | 399/27 |
| 2001/0043826 | A1 * | 11/2001 | Mizoguchi et al. | 399/359 |
| 2008/0310884 | A1 * | 12/2008 | Matsumoto et al. | 399/262 |

* cited by examiner

*Primary Examiner* — Hoang Ngo

(74) *Attorney, Agent, or Firm* — Ronald E. Prass, Jr.; Prass LLP

(57) ABSTRACT

A module installable in an electrostatographic printing apparatus includes a first housing suitable for retaining marking material, and extending substantially a width of a rotatable charge receptor. The first housing includes an input port and an output port. The module includes a second housing external to the first housing, the second housing forms a conduit between the output port and the input port. The second housing contains a quantity of marking material, the quantity being suitable as at least part of an initial fill of marking material for the first housing.

14 Claims, 2 Drawing Sheets

APPARATUS AND SYSTEMS INCLUDING AN IMAGING MODULE AND DEVELOPER MODULE INSTALLABLE IN AN ELECTROSTATOGRAPHIC PRINTING SYSTEM

FIELD OF DISCLOSURE

The disclosure relates to development systems used in xerography or electrophotography. In particular, the disclosure relates to apparatus and systems including an imaging module having a developer module engageble to a developer housing of the imaging module for dispensing an initial fill of developer and/or receiving and dispensing reclaimed toner from the imaging module charge receptor housing to the imaging module developer housing.

BACKGROUND

In electrostatographic or xerographic printing processes, a photosensitive imaging member such as a charge receptive belt or cylinder surface is uniformly charged by a corona unit, a charged contact roller, or an array of light emitting diodes. The uniformly charged photoreceptor or charge receptor surface is then image-wise exposed to a light image of an original document to be copied, or a scanned laser image produced by image data acting on a laser source. The light dissipates charge at exposed portions of the photoconductor surface to record on the charge receptor surface an electrostatic latent image that corresponds to informational areas of the original document to be copied.

After the latent image is recorded on the photoreceptor, the latent image is developed by causing toner particles to adhere electrostatically to the charged portions of the photoreceptor surface forming a toner image in charged area development systems, or causing toner particles to adhere electrostatically to discharged portions of the photoreceptor in discharged area development systems. The developed toner image is subsequently transferred to a sheet using electrostatic forces, and fixed or fused using heat and pressure or radiant fusing to melt and bond toner particles into the sheet. The charge receptor may then be cleaned by removing, for example, used toner particles from a surface thereof.

Typically, the charge receptor may be a photoreceptor or rotatable metal drum having a charge-retentive surface formed of materials including silicon, amorphous selenium or its alloys, and/or other photoconductors. In the development step, the photoreceptor is presented with marking material such as developer, a mixture of toner particles and larger, typically iron, reusable carrier particles. The carrier particles have a coating. The coated carrier and toner generate a triboelectric charge separation when agitated, i.e., electron transfer between the coated carrier and toner occurs, causing the carrier to carry a net positive charge and the toner to carry a net negative charge, or vice versa. A magnetic roll or developer roll is used to apply toner particles to a surface of the photoreceptor. The toner particles have a charge that is opposite in polarity to the charge of the latent image recorded on the photoreceptor. The photoreceptor attracts the toner particles to form a visible image on the photoreceptor surface. A bias voltage may be applied to the developer roll to control the attractive forces between the toner and photoreceptor.

In related art systems, the charge receptor and developer roll are disposed in a first housing. The first housing defines an input and an output, and is configured to contain developer that is delivered from a second developer supply housing that defines a single opening that communicates with the first housing input. The first housing input may be, for example, disposed above the output when the first housing is installed in a printing system. The second housing may be configured so that when the second housing is engaged with the first housing, the single opening is arranged at a bottom portion of the second housing so that developer contained by the engaged second housing is enabled to fall through the single opening, and into the first housing through the first housing input. The magnetic roll may acquire charged toner and carrier particles, and as the magnetic roll rotates, cause toner particles to detach from carrier particles located on a surface of the magnetic roll and adhere to the portions of the charge receptor surface for producing a toner image thereon. Developer is typically caused to move from the first housing inlet to the photoreceptor in a generally horizontal direction in related art systems.

After the development step, a subsequent toner image transfer step, a separation or detack step, and a step of fixing or fusing of the toner image to a sheet, the charge receptor is cleaned in a cleaning step. Remaining toner that did not transfer to media during the transfer step may be removed from the photoreceptor by a cleaning blade or rotatable brush, for example. A reclaim system may be used to reclaim toner. In a typical reclaim system, captured toner is routed back into the first housing. A reclaim output is typically located above a reclaim input or dispense output.

SUMMARY

After repeated use, marking material such as developer including powdered toner and carrier particles may degrade as amounts of toner in the developer mixture are consumed during development and toner image transfer steps, while amounts of carrier particles remain substantially constant, causing a toner to carrier ratio to drift below preferred values. Toner is removed from the developer mixture continually as it is developed to a photoreceptor, and fresh toner is added to a developer housing of the first housing.

Apparatus and systems are provided that include a developer module configured for containing and/or receiving developer and reclaimed toner, and dispensing developer and/or reclaimed toner to a developer housing for development in an imaging module. Apparatus and systems accommodate greater design latitude, and logistical and design efficiency for developer systems and xerographic printing systems.

This disclosure is not limited to the particular apparatus and systems described, as these may vary. The terminology used in the description is for the purpose of describing the particular versions or embodiments only, and is not intended to limit scope.

As used in this document, the singular forms "a," "an," and "the" include plural references unless the context clearly dictates otherwise. Unless defined otherwise, all technical and scientific terms used herein have the same meanings as commonly understood by one of ordinary skill in the art. Nothing in this disclosure is to be construed as an admission that the embodiments described in this disclosure are not entitled to antedate such disclosure by virtue of prior invention.

In an embodiment, a developer module installable in an electrostatographic printing apparatus may be configured for receiving, retaining, and dispensing developer. The developer module is configured for operably engaging with an imaging module that is installable in a printing apparatus. The imaging module may include a first housing having a developer housing suitable for retaining marking material, the first housing extending substantially a width of a rotatable charge receptor;

an input port and an output port associated with the first housing. The developer module comprises a second housing external to the first housing, forming a conduit between the output port and the input port; and a quantity of marking material disposed in the second housing, the quantity being suitable as at least part of an initial fill of marking material for the first housing. The second housing may define a generally funnel-like shape, and may be disposed outside of a width of a charge receptor associated with the first housing.

In an embodiment, the second housing or developer module may include an openable arrangement operatively disposed between the second housing and the input port, whereby opening of the openable arrangement allows passage of marking material from the second housing through the input port. The openable arrangement may include a pull strip. In an embodiment, the output port may be disposed substantially above the input port when the imaging module is installed in a printing apparatus. When the imaging module is in a storage state, the developer module, or second housing, may contain at least part of an initial fill of marking material, and the first housing may be substantially empty of marking material.

In an embodiment, apparatus may include an auger for outputting marking material associated with the output port. Apparatus may include at least one mixing auger disposed at least partially in the first housing near the input port. Apparatus may include a rotatable charge receptor, such as a photoreceptor, disposed in communication with and/or contained by the first housing, whereby marking material in the first housing can be applied to the charge receptor.

The marking material may include powdered toner. The marking material may be developer including powdered toner and carrier particles. The toner and carrier particles generated a charge separation when agitated. Apparatus may include a magnetic roll for applying charged marking material to the charge receptor, the magnetic roll being disposed below the output port and interposing the input port and the charge receptor.

Exemplary embodiments are described herein. It is envisioned, however, that any system that incorporates features of apparatus and systems described herein are encompassed by the scope and spirit of the exemplary embodiments.

DETAILED DESCRIPTION

Figure 1:
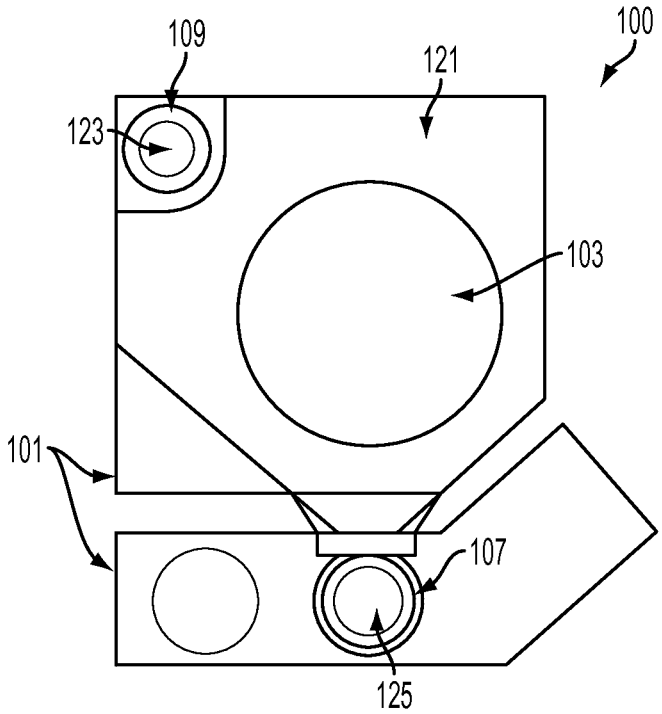
FIG. 1 shows a diagrammatical front elevational view of a developer module engaged to an imaging module in accordance with an exemplary embodiment.

Exemplary embodiments are intended to cover all alternatives, modifications, and equivalents as may be included within the spirit and scope of the apparatus and systems as described herein.

Reference is made to the drawings to accommodate understanding of apparatus and systems including a developer module engageable to an imaging module installable in an electrostatographic printing apparatus. In the drawings, like reference numerals are used throughout to designate similar or identical elements. The drawings depict various embodiments of illustrative apparatus and systems including imaging modules having developer modules installable electrostatographic printing systems.

Apparatus and systems are provided that include a developer module configured for containing and/or receiving marking material, and configured to engage to an imaging module for dispensing marking material, and providing a conduit for reclaimed toner. The marking material may be a developer including powdered toner and carrier particles. "Developer" as used herein refers to two-component developer that includes toner particles and larger, typically iron, reusable carrier particles. The carrier particles form a coating that generates triboelectric charge separation when the carrier particles are agitated. The charged carrier particles attract the oppositely charged toner particles thereby associating the carrier and toner particles.

Apparatus and systems include a developer module engageable to an imaging module installable in an electrostatographic printing system for delivering an initial fill of developer. The imaging module may include a first housing and a second housing, or developer module, external to the first housing. Developer may be delivered through a first opening defined by the second housing to the first housing that contains or communicates with a charge receptor such as a cylindrical, rotatable photoreceptor. The module may be configured for the second housing to receive reclaimed marking material such as dissociated toner particles from the first housing through a second opening defined by the second housing. Apparatus and systems accommodate greater design latitude, robustness, and operating and design efficiency for developer systems and xerographic printing systems.

The first housing may define an input port and an output port. The second housing may be configured to engage to the first housing so that the first opening defined by the second housing communicates with the input port of the first housing, and the second opening defined by the second housing communicates with the output port of the first housing. Accordingly, the module installable in an electrostatographic printing apparatus or system may provide a conduit between the first housing and the second housing for transfer of marking material between the two housings, and the second housing may provide a conduit between the input port and output port of the first housing, external to the first housing.

The imaging module of apparatus may include a developer roll such as a magnetic roll for applying charged marking material to a charge receptor. The magnetic roll may be disposed below the output port, interposing the input port and the charge receptor. For example, the first housing may be formed to extend substantially a width of a rotatable charge receptor. A magnetic roll may be arranged adjacent to and co-extending with the charge receptor, and may be caused to rotate to carry obtained developer to a position near the photoreceptor at which the toner particles become disassociated from the carrier particles, and adhere as desired to the charged photoreceptor having an electrostatic latent image produced during charging and exposing steps of the printing processes to form a toner image.

The developer module, or second housing, may define a generally funnel-like shape, and may, for example, be disposed outside of a width of a charge receptor associated with the first housing. The second housing may include an openable arrangement operatively disposed between the second housing and the input port, whereby opening of the openable arrangement allows passage of marking material from the second housing through the input port. For example, the openable arrangement may include a pull strip or suitably constructed shutter mechanism. In an embodiment, the output port may be disposed substantially above the input port when the module is installed in a printing apparatus. When the module is in a storage state, the second housing may contain at least part of an initial fill of marking material, and the first housing may be substantially empty of marking material. The second housing may include a high quality seal at the second opening suitable for containing marking material when the second housing is in a storage state, but is disengaged from the first housing. The pull strip may be configured to seal the first opening when the imaging module having the developer module engaged thereto is in a storage state.

Apparatus may include an auger for outputting marking material through the output port, the auger being disposed adjacent to the output port. Apparatus may include at least one mixing auger disposed at least partially in the first housing near the input port. Apparatus may be configured so that marking material is introduced to the first housing from an engaged or installed second housing by way of the input port, and caused to migrate in a substantially vertical direction to be acquired by a magnetic developer roll disposed above the input port. The photoreceptor may also be disposed above the input port of the first housing. In particular, the magnetic roll may be caused to rotate to carry obtained developer to a position near the photoreceptor at which the toner particles become disassociated from the carrier particles, and adhere as desired to the charged photoreceptor having an electrostatic latent image produced during charging and exposing steps of the printing processes to form a toner image.

After forming the toner image, the toner image is subsequently transferred and fixed to media during transfer, detack, and fixing or fusing steps. Residual toner that remains after transfer to media of the toner image may be removed by cleaning the surface of the photoreceptor using, for example, a cleaning blade or other suitable cleaning system. Toner that is removed from a surface of the photoreceptor may be caused to exit the photoreceptor unit by way of an auger system that forces toner through the output port. The recovered toner may be routed to the module or second housing for disposal and/or redelivery to the first housing.

Accordingly, a second housing of a developer module may be filled with an initial fill volume of new developer, and shipped and/or packaged together with or separately from a first housing that communicates with a photoreceptor. When engaged, the second housing may be caused to receive waste toner from an engaged first housing, and after receiving the waste toner, and may be caused to deliver the reclaimed toner to the first housing of the imaging module through the second housing first opening and first housing input port to replenish a developer supply contained by the first housing. The developer module engaged to the first housing of the imaging module co-locates initial fill volume delivery and reclaimed toner delivery functions. The initial fill volume may be a maximum volume of marking material accommodated by the developer module, or a partial volume of marking material.

FIG. 1 shows a diagrammatical front elevational view of a developer module engaged to an imaging module in accordance with an exemplary embodiment. In particular, FIG. 1 shows an imaging module 100 installable in an electrostatographic printing system. The imaging module 100 may include a first housing 101 configured for containing developer and providing developer for application to a charge receptor such as a photoreceptor 103. The photoreceptor 103 may be contained in the first housing 101 as shown.

The first housing 101 includes an input port 107 and an output port 109. As shown in FIG. 1, the input port 107 may be disposed at a position below the output port 109 when the imaging module 100 is installed in a printing system.

The imaging module 100 may include a second housing or developer module 121. The second housing, developer module 121, may define a first opening located at a bottom of the second housing 121 for facilitating communication with the first housing 101 by way of the input port 107. The second housing 121 may define a second opening located at a top of the second housing 121 for facilitating communication with the first housing 101 by way of the output port 109. The second housing or developer module 121 is configured to be engaged to the first housing 101 of the imaging module 100 for providing developer, and removing and reusing reclaimed toner. The developer module or second housing 121 may be at least partially constructed of a transparent material. For example, the second housing 121 may be formed to include a transparent window through which a color of material contained inside is observable.

The second housing 121 may be generally funnel-shaped, and may be configured to funnel marking material such as developer through the first opening and through a developer input port 107 of the first housing 101 when the second housing 121 is engaged thereto. Marking material may enter the second housing 121 through a second opening, for example, from the output 109 of the first housing. An auger 123 or similar mechanism may be disposed near the output port 109 and may be configured to cause marking material to exit the first housing 101 into the second housing 121. A transport system such as a supply auger 125 may be configured to cause developer to be transferred from the second housing 121 to and within the first housing 101. The supply auger 125 may be disposed partially within an input 107 configured as an input port, extending into the first housing. The supply auger 125 may be advantageously disposed below a developer member, such as a magnetic roll (not shown). As such, developer may be made available for application of toner particles to the charge receptor or photoreceptor 103 for a development step in xerographic printing processes, for example. Embodiments may include an admix auger arranged adjacent to the supply auger 125 for mixing developer received from the second housing or developer module 121, and supplying the mixed developer to the supply auger 125 for developing the charge receptor 203. In embodiments, the developer module 121 may be configured to engage to the first housing 101 to deliver developer to the supply auger 125 as shown, or both the supply auger 125 and the admix auger simultaneously.

The first and second openings of the second housing 121 may be sealed when the module 100 is in a storage state, and/or when the second housing 121 is disengaged from the first housing 101 and in a storage state. The seal may be a shutter seal or pull strip, for example. A pull strip (not shown) may be formed of paper or plastic with an adhesive backing for adhering to a surface of the second housing 121 at the first opening for sealing thereof. The pull strip may be removed upon engagement of the second housing 121 with the first housing 101, or installation of the module 100.

Waste toner may be caused to transfer from the first housing 101 to the second housing 121 by way of the second opening and output 109 and auger 123. The reclaimed toner may be caused to fall from the upper portion of the engaged second housing 121, and funneled for re-delivery to the first housing 101 by way of the first opening and first housing input port 107. One or more system(s) 100 may be implemented in, for example, a xerographic printing system.

Figure 2:
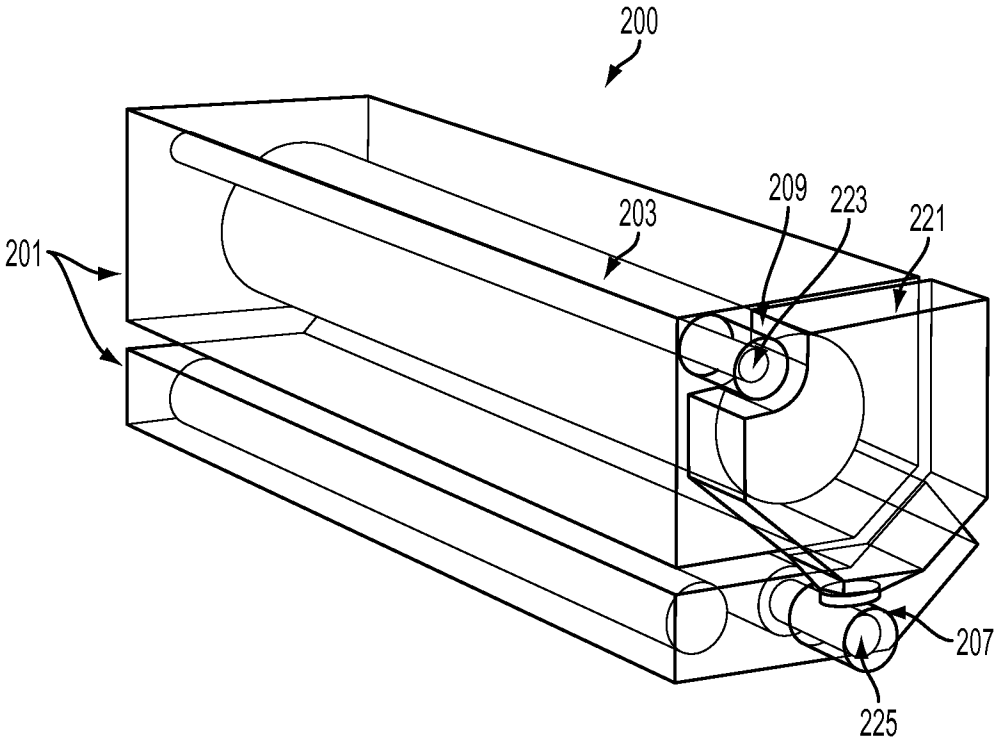
FIG. 2 shows a diagrammatical perspective view of a developer module engaged to an imaging module in accordance with an exemplary embodiment.

FIG. 2 shows a diagrammatical perspective view of a developer module engaged to an imaging module in accordance with an exemplary embodiment. In particular, FIG. 2 shows an imaging module 200 installable in an electrostatographic printing system. The imaging module 200 may include a first housing 201 configured for containing developer and providing developer for application to a charge receptor such as a photoreceptor 203. The photoreceptor 203 may be contained in the first housing 201 as shown.

The first housing 201 includes an input port 207 and an output port 209. As shown in FIG. 2, the input port 207 may be disposed at a position below the output port 209 when the imaging module 200 is installed in a printing system.

The imaging module 200 may include a second housing or developer module 221. The second housing 221 may define a first opening located at a bottom of the second housing 221 for facilitating communication with the first housing 201 by way of the input port 207. The second housing 221 may define a second opening located at a top of the second housing 221 for facilitating communication with the first housing 201 by way of the output port 209. The second housing or module 221 may be configured to be engaged to the first housing 201 of the imaging module 200 for providing initial fill of developer, and a conduit for reclaimed toner. The fill of developer may be partial fill or a fill corresponding to a maximum capacity of the developer module 221. The developer module or second housing 221 may be at least partially constructed of a transparent material. For example, the second housing 221 may be formed to include a transparent window through which a color of material contained inside is observable.

The second housing 221 may be generally funnel-shaped, and may be configured to funnel marking material such as developer through the first opening and through a developer input port 207 of the first housing 201 when the second housing 221 is engaged thereto. Marking material may enter the second housing 221 through a second opening at the top of the second housing 221, for example, from the output 209 of the first housing. An auger 223 or similar mechanism may be disposed near the output port 209 and may be configured to cause marking material to exit the first housing 201 into the second housing 221. The auger 223 may be arranged so that a portion of the auger 223 is disposed in the output port 209, and a portion of the auger 223 is disposed in the first housing 201.

A transport system such as a supply auger 225 may be configured to cause developer to be transferred from the second housing 221 to and within the first housing 201. The supply auger 225 may be disposed partially within an input port 207, extending into the first housing 201. The supply auger 225 may be advantageously disposed below a developer member, such as a magnetic roll (not shown). As such, developer may be made available for application of toner particles to the charge receptor or photoreceptor 203 for a development step in xerographic printing processes, for example.

The first and second openings of the second housing 221 may be sealed when the imaging module 200 is in a storage state, and/or before the second housing 221 is engaged to the first housing 201. The seal may be a shutter seal or pull strip, for example. A pull strip (not shown) may be formed of paper or plastic with an adhesive backing for adhering to a surface of the second housing 221 at the first opening for sealing thereof. The pull strip may be removed upon engagement of the second housing 221 with the first housing 201, or installation of the imaging module 200.

Waste toner may be caused to transfer from the first housing 201 to the second housing 221 by way of the second opening and the output 209 and the auger 223. The reclaimed toner may be caused to fall from the upper portion of the engaged second housing 221, and funneled for re-delivery to the first housing 201 by way of the first opening and first housing input port 207. One or more imaging module(s) 200 may be implemented in, for example, a xerographic printing system.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. An imaging module installable in an electrostatographic printing apparatus, comprising:

a first housing suitable for retaining marking material, the first housing extending substantially a width of a rotatable charge receptor;

an input port associated with the first housing;

an output port associated with the first housing;

a second housing external to the first housing, forming a conduit between the output port and the input port, the conduit being external to the first housing the second housing defining a generally funnel-like shape, the second housing defining an opening at a lowermost portion of the second housing for communicating with the input port of the first housing; and a quantity of marking material disposed in the second housing, the quantity being suitable as at least part of an initial fill of marking material for the first housing.

2. The module of claim 1, further comprising:

an openable arrangement operatively disposed between the second housing and the input port, whereby opening of the openable arrangement allows passage of marking material from the second housing through the input port.

3. The module of claim 2, the openable arrangement including a pull strip.

4. The module of claim 2, the openable arrangement including a shutter.

5. The module of claim 1, the output port being disposed substantially above the input port when the module is installed in a printing apparatus.

6. The module of claim 1, wherein, when the module is in a storage state, the second housing contains at least part of an initial fill of marking material, and the first housing is substantially empty of marking material.

7. The module of claim 1, wherein the second housing is disposed outside a width of a charge receptor associated with the first housing.

8. The module of claim 1, further comprising an auger for outputting marking material associated with the output port.

9. The module of claim 1, further comprising at least one mixing auger disposed at least partially in the first housing near the input port.

10. The module of claim 1, further comprising a rotatable charge receptor disposed in communication with the first housing, whereby marking material in the first housing can be applied to the charge receptor.

11. The module of claim 1, wherein the marking material includes powdered toner.

12. The module of claim 1, wherein the marking material includes powdered toner and carrier particles.

13. The module of claim 1, comprising:

a magnetic roll for applying marking material to the charge receptor, the magnetic roll being disposed below the output port and interposing the input port and the charge receptor.

14. The module of claim 1, wherein the second housing is at least partially formed of a transparent window.

* * * * *

UNITED STATES PATENT AND TRADEMARK OFFICE

CERTIFICATE OF CORRECTION

PATENT NO. : 8,918,027 B2
APPLICATION NO. : 13/727571
DATED : December 23, 2014
INVENTOR(S) : Jeffrey M. Fowler et al.

It is certified that error appears in the above-identified patent and that said Letters Patent is hereby corrected as shown below:

On the Title Page, Item (72)

Please correct the residence of the second inventor as follows:

Ian Harpur, Welwyn Garden City (GB)

Signed and Sealed this
Fifth Day of May, 2015

Michelle K. Lee

Michelle K. Lee
*Director of the United States Patent and Trademark Office*